United States Patent [19]

Russo, Sr.

[11] Patent Number: 5,031,792

[45] Date of Patent: Jul. 16, 1991

[54] CONTAINER FOR BULK HANDLING OF FLUIDS

[75] Inventor: Joseph R. Russo, Sr., Ramsey, N.J.

[73] Assignee: Milan Box Corporation, Milan, Tenn.

[21] Appl. No.: 584,735

[22] Filed: Sep. 19, 1990

Related U.S. Application Data

[63] Continuation-in-part of Ser. No. 298,115, Jan. 17, 1989.

[51] Int. Cl.[5] ..... B65D 5/60

[52] U.S. Cl. ..... 220/403; 220/462

[58] Field of Search ..... 220/403, 462, 440, 5 A, 220/1.5

[56] References Cited

U.S. PATENT DOCUMENTS

| | | | |
|---|---|---|---|
| 2,926,830 | 3/1960 | Kennedy et al. | 220/462 |
| 3,194,471 | 7/1965 | Murphy | 220/462 |
| 4,421,253 | 12/1983 | Croley | 220/462 X |
| 4,516,692 | 5/1985 | Croley | 220/403 X |
| 4,623,075 | 11/1986 | Riley | 220/462 X |
| 4,793,519 | 12/1988 | Voorhies | 220/403 X |
| 4,850,506 | 7/1989 | Heaps, Jr. et al. | 220/403 |

*Primary Examiner*—Steven M. Pollard

*Attorney, Agent, or Firm*—Morgan & Finnegan

[57] ABSTRACT

A container for bulk handling of fluid materials which includes a rigid outer shell structure within which is positioned a flexible bag means adapted to receive, transport and discharge fluids. An intermediate liner is positioned between the shell and the flexible bag for prevention of abrasion of the bag surface. The intermediate liner is unattached to either the bag or the outer shell.

16 Claims, 7 Drawing Sheets

CONTAINER FOR BULK HANDLING OF FLUIDS

This patent application is a continuation-in-part of U.S. patent application Ser. No. 07/298,115, filed 1/17/89, pending, herein incorporated by reference.

BACKGROUND OF THE INVENTION

1. Field of the Invention

This invention relates to shipping containers for bulk handling of liquids, fine powders, granular products and other matter with flow characteristics, and specifically to their shipment by way of a collapsible bag encased in a strong outer shell.

2. Description of the Prior Art

Containerized fluids experience severe handling forces such as vibrations, incline-impact, and droppage during shipment. Fluids are frequently shipped by way of a "bag in a box" whereby a collapsible bag is enclosed by a rigid outer shell and the fluid is dispensed through portals. In this type of shipment container, the outer walls of the enclosed bag are subjected to continuous and abrasive movement of the bag against the walls of the rigid container. Such abrasion can result in bag breakage and leakage and resultant loss of contents and contamination of the surrounding area.

Prior container designs have sought to lessen abrasion by fitting the bag closely to the inner volume, as suggested in U.S. Pat. No. 4,157,609, or securing the bag to the inside of the container by a support mechanism as suggested in U.S. Pat. No. Re 28,846. Use of a double layer bag as disclosed in U.S. Pat. No. 4,585,143 avoids spillage by providing an extra layer.

None of these solutions is directed to the primary source of the problem, the abrasion of the bag from the outside rigid shell resulting from relative movement between these parts. A need exists for a structure which will lessen the abrasive forces experienced by the collapsible container bag during shipment.

3. Objects of the Invention

With the foregoing in mind, it is an object of this invention to provide a new and improved shipping container for liquids.

Another object of this invention is to provide a new and improved container for shipping liquids which has a separate corrugated intermediate liner to protect an internal bag from abrasive contact with the surface, corners and seams on the inner surface of an outer rigid shell.

It is further the object of this invention to provide a container for shipping bulk liquids which has an internal multiple layer collapsible bag fitted within the inner dimensions of an outer container shell, and which is secured to two top edges of the inner surface of the outer shell; the internal bag having a chimney-like top spout or bung for either filling or discharge and also having a discharge fitment at the bottom of a side wall designed for insertion of a discharge valve through the side wall.

A further object of the invention is to provide a new and improved shipping container for fluids wherein the fluid is enclosed within a flexible bag, which bag is positioned within an outer shell, with an intermediate corrugated liner preventing abrasion between the bag and the outer shell.

Another object of the invention is to provide a movable container structure for liquid materials which permits easy transport, storage and dispensing of the fluid within a bag-like member.

Additional objects and advantages of the invention will be set forth in the description which follows and, in part, will be obvious from the description, the objects and advantages being realized and obtained by means of the parts, methods, structures, apparatus and procedures particularly pointed out in the appended claims.

SUMMARY OF THE INVENTION

The present invention combines unique arrangements which minimize shock and abrasive forces on a liquid container bag wall positioned within a shipping container. In accordance with this invention, a multiple layer flexible, collapsible bag is positioned to closely fit within inner surfaces of the box-like outer container. The double bag may have flap-like extensions for securement to the container. In accordance with this invention, means are provided for protecting the multilayer bag. As embodied this means is an unattached intermediate liner sandwiched between the double bag and the outer walls. The intermediate liner is preferably constructed of a corrugated material non-abrasive to the double layer bag and is neither attached to the outer shell nor to the bag and thus is free to move with the bag as it experiences shock, vibrations or other forces. The outer shell includes means for permitting the container to be moved from one location to another and for convenience in storing. As embodied, this means comprises a pallet means permanently attached to the outer container.

The outer shell, pallet, flexible bag and liner are constructed into a unitary container for transportation and storage purposes. With this unitary construction the user need not supply pallet or other support means by which to transport the container or by which to position the container for storage.

The accompanying drawings which are incorporated in and constitute part of the specification illustrate an embodiment of the invention and together with the description serve to explain the principle of the invention. The invention consists of the novel steps, instructions and improvements as shown and described.

DESCRIPTION OF THE PREFERRED EMBODIMENT

The invention will be best understood by detailed reference to embodiments illustrated in the accompanying drawings.

Figure 1:
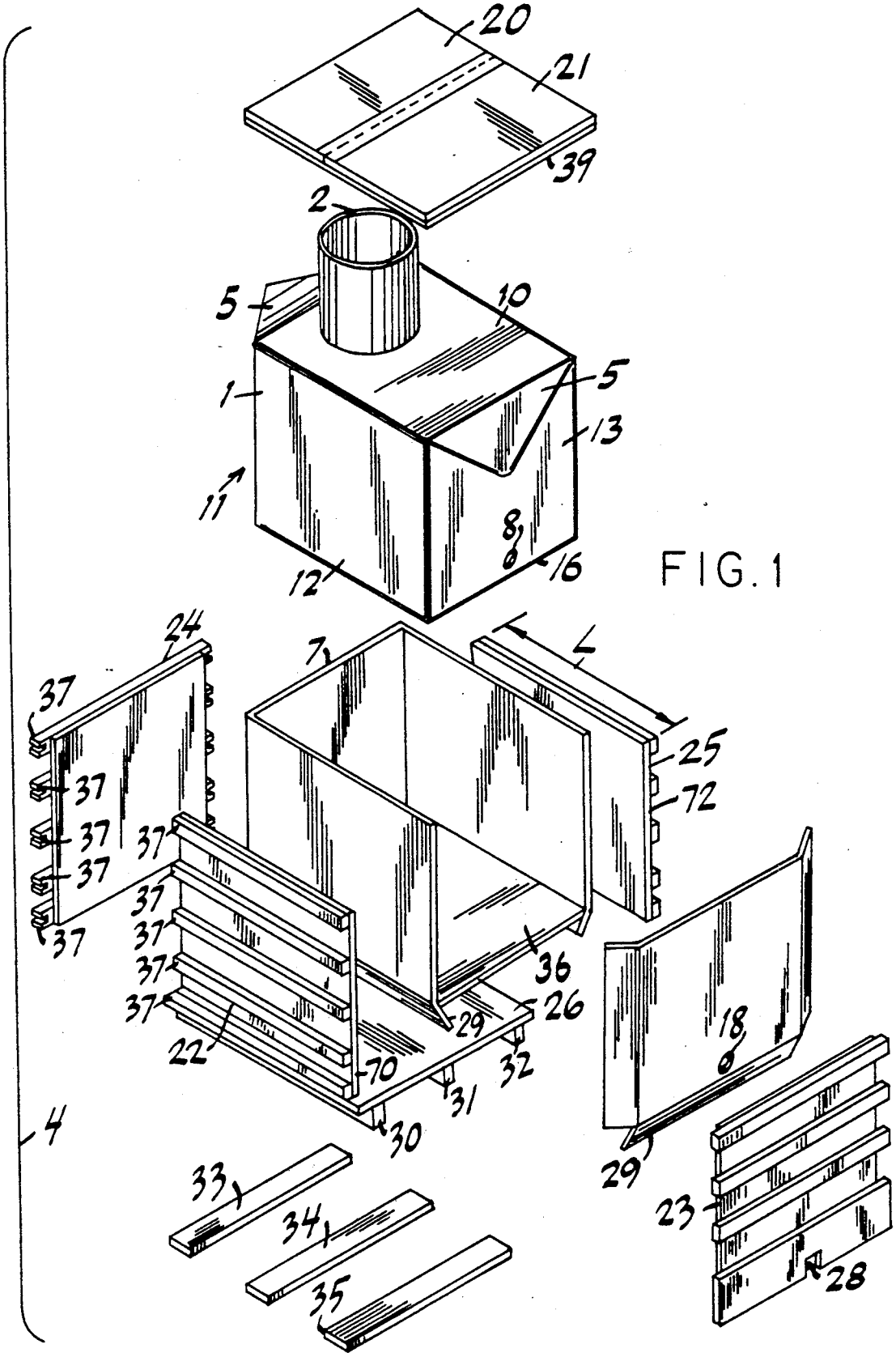
FIG. 1 is an exploded perspective view of a first embodiment of the entire shipping container of the present invention, including outer shell, inner collapsible double bag, and intermediate liner.
Figure 2:
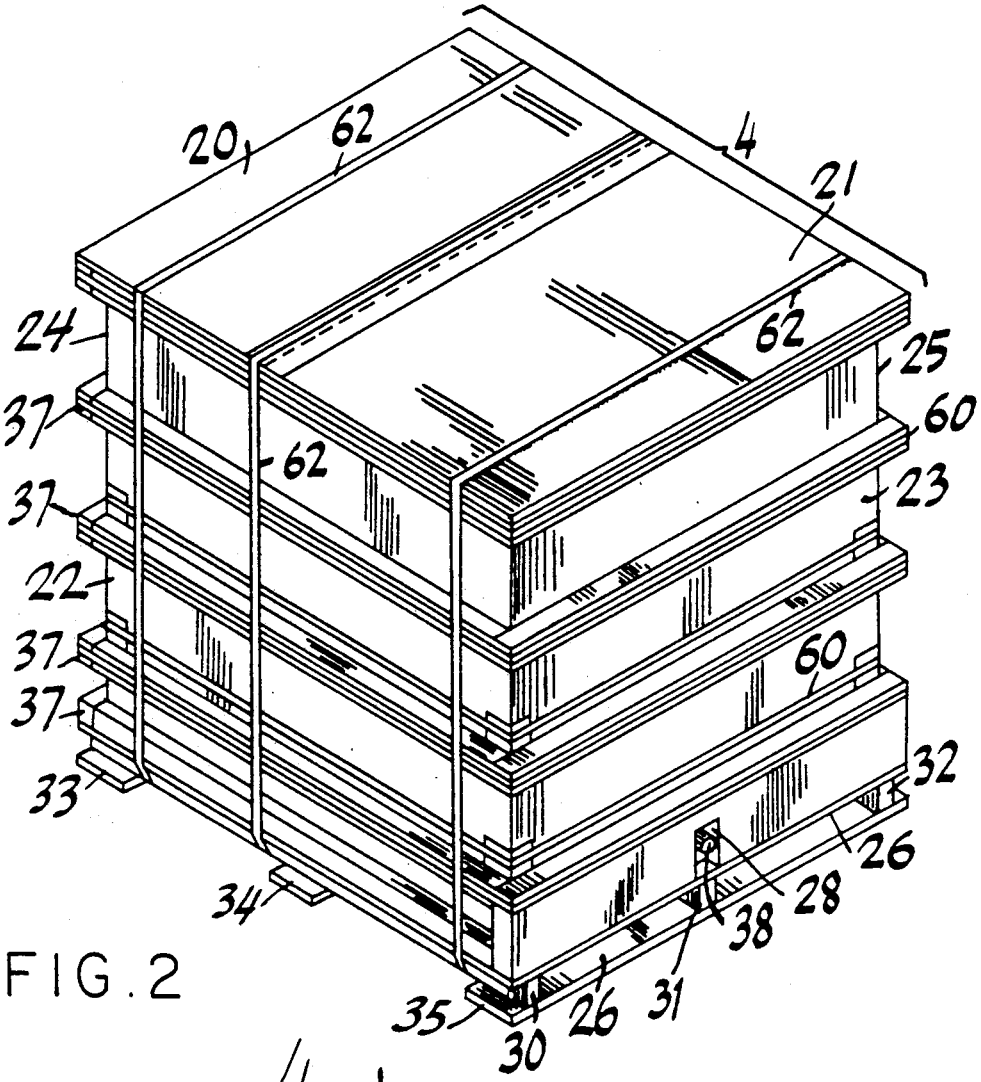
FIG. 2 is a perspective view of the shipping container of FIG. 1, assembled in accordance with this invention, and with means inserted for bottom dispensing.

A first embodiment of a fully assembled shipping container, shown in FIG. 2 is exploded in FIG. 1 to reveal the principal elements which consist of a flexible bag 1, an outer rigid shell 4 and an intermediate liner 7.

In accordance with this invention is means for providing a rigid outer shell for the flexible bag means and for providing an integral pallet-like structure permitting individualized transportation and storage of the shell and its contents. As embodied, the rigid outer shell 4 protects the inner bag 1 and its contents from blunt trauma and includes means for permitting transportation and storage.

The outer shell 4 is constructed of four side walls 22, 23, 24 and 25, a top wall with two sections 20 and 21 and a bottom wall 26 with integral pallet. Bottom wall 26 also serves as the pallet deck. The pallet is constructed of the deck (bottom wall 26), a bottom surface consisting of wooden boards (base members) 33, 34 and 35 attached to the three wooden skids 30, 31 and 32. The deck, skids and/or boards can be made of any nailable and stapleable material. The pallet is permanently attached to the container by joining bottom wall 26, at its upper surface, to the bottom edges of outer shell walls 22, 23, 24 and 25 by any convenient means such as nailing. The outer shell walls 22, 23, 24 and 25 are not attached to each other.

The outer shell is rigid and strong and is preferably constructed of plywood but other materials capable of being nailed or stapled can be used. For example, the material may be wood, particle board, flake board or oriented strand board. Grooved wooden reinforcing cleats 37 traverse the horizontal perimeter of the outer shell 4 and accommodate horizontal strapping bands 60 made of steel or the like, which, in final assembly, position and secure the side walls in the desired position. Longitudinal (vertical) strapping bands 62 secure the top walls 20, 21 to the container shell 4.

As shown in Figure 1, the cleats 37 of opposing sidewalls 23, 24 extend beyond sidewalls 23, 24. Also, as shown in FIG. 2, the cleats 37 of opposing sidewalls 22, 25 are about the same length ("L") as sidewalls 22, 25. For an assembled container, the portions of the cleats 37 of sidewalls 23, 24 which extend beyond sidewalls 23, 24 rest against (overlap) the cleats 37 and edges 70, 72 of sidewalls 22, 25, respectively. Thus, sidewalls 22, 25 and their cleats 37 are located between the cleats 37 of the sidewalls 23, 24. As a result, the sidewalls 23, 24 are located between the sidewalls 22, 25. This positioning of sidewalls and cleats is advantageous. Without this positioning, the force of the horizontal straps 62 would collapse the container sidewalls 22, 23, 24, 25.

In accordance with the invention, a reinforced double layer collapsible bag is provided including means for attaching the bag 1 to the outer shell 4 is shown in FIG. 1. Bag 1 has four side walls 11, 12, 13 and 14, top wall 10 and a bottom wall 16. Walls 10, 11, 12, 13, 14 and 16 meet at their respective corners as shown in FIG. 1 to a form which, when inflated, fits closely within the internal dimensions of the outer rigid shell. Bag 1 may be constructed by heat sealing ends to a tube-form of polyethylene or other plastic material. In this manner, the end walls are heat sealed at the appropriate corners to form a unitary, airtight collapsible bag.

Figure 3:
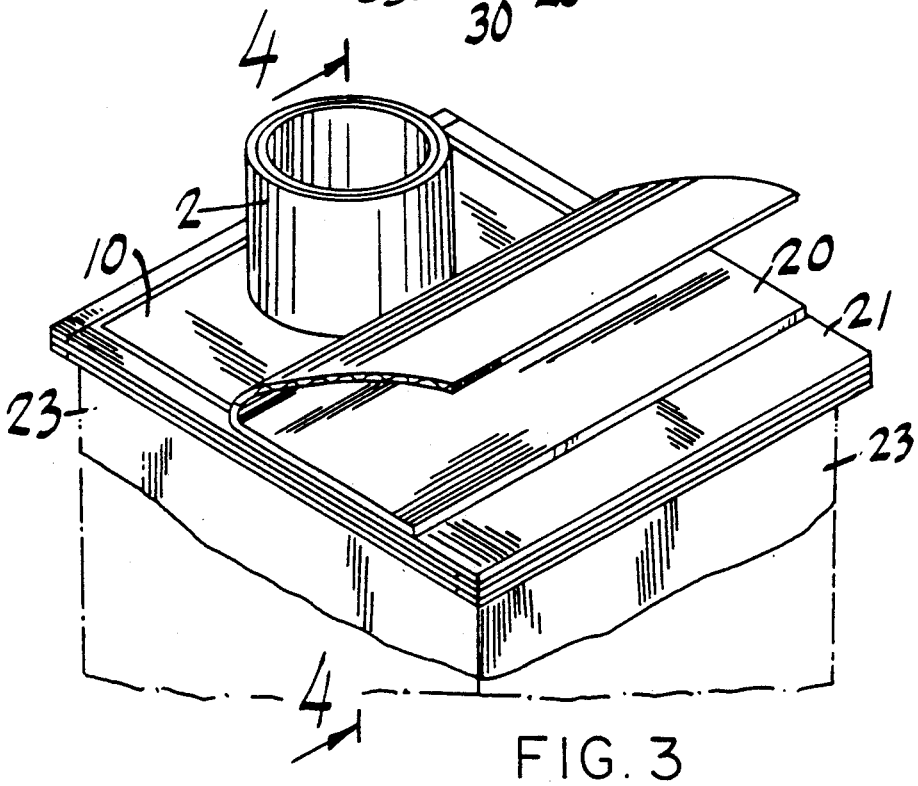
FIG. 3 is a perspective view of the top port of FIG. 1 ready for filling or dispensing.

In accordance with the invention, means is provided for permitting flow of liquid into and out of the bag means as shown. As embodied, bag 1 is constructed with a chimney-like upper portal 2, which is an extension of the collapsible double bag material. When not in use, upper portal 2 is tied with rope or the like and enclosed inside rigid outer shell 4. Upper portal 2 is accessed for either filling or dispensing by opening or removing a portion 20 of the top wall of the rigid outer shell 4. FIG. 3 illustrates the upper portal 2 in its open position. A dispensing pump can be accommodated on the stationary portion 21 of the top wall.

Figure 4:
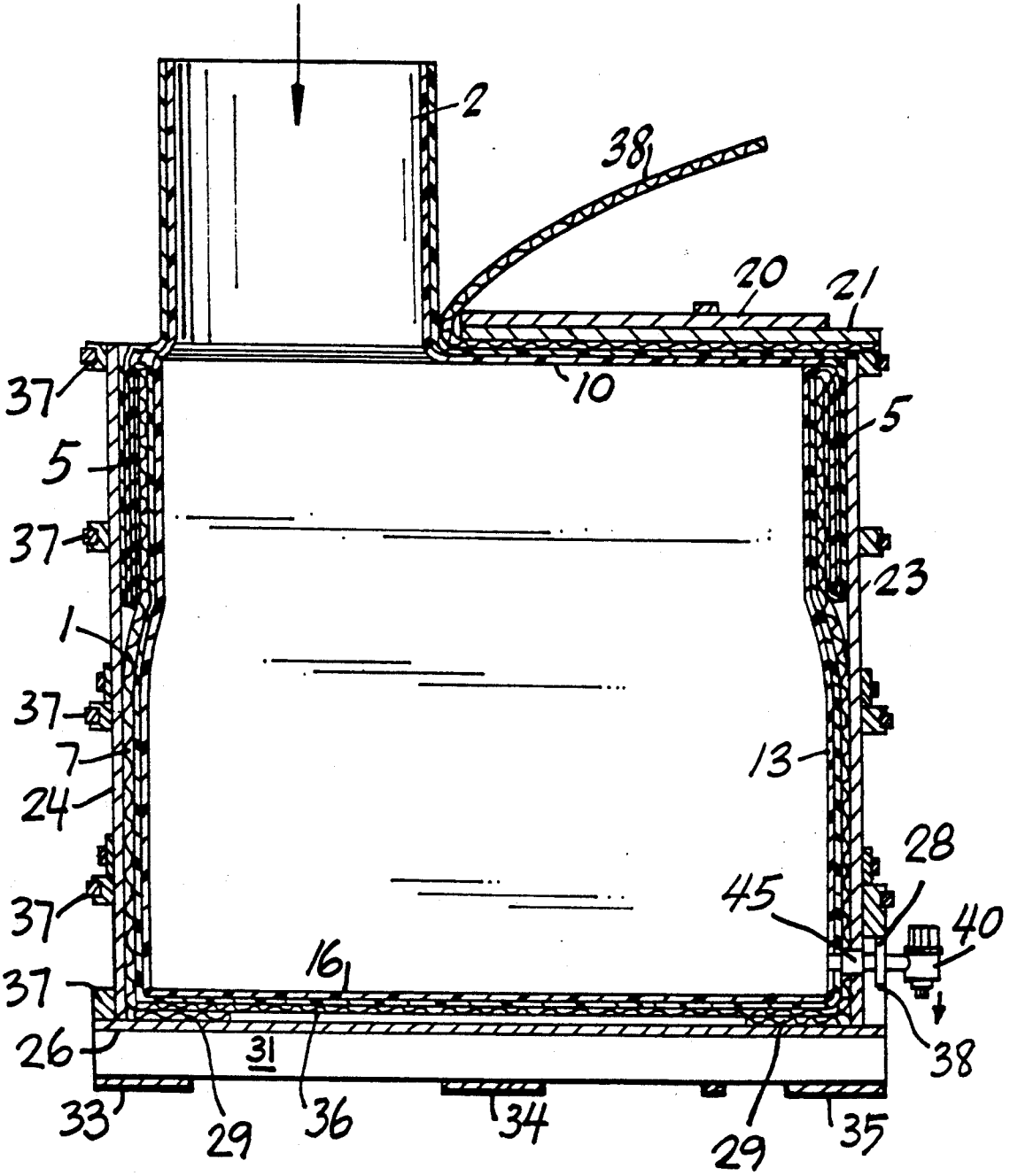
FIG. 4 is a vertical section of the assembled shipping container of FIG. 1 along lines 4—4 of FIG. 3.

In accordance with the invention, means is provided for permitting the insertion of a dispensing valve adjacent the bottom of the bag. As embodied, bag 1 is constructed with a heat sealed bottom portal 8 (schematically shown on FIG. 1), consisting of a fitment 38 (shown in FIG. 2) heat sealed through the bag layers from inside the bag. The heat sealed fitment 38 is capable of permitting the insertion of a conventional needle or gate valve. Upon delivery, the valve is inserted by seating it into the threaded area of the fitment 38. Typically the fitment is a hollow threaded bung with threads on its inner walls. While being seated, a sharp nail-like probe on the valve pierces the two layers of the bag. FIG. 1 shows the pierced portion of the portal 8. Once the heat seal is pierced and the valve is inserted, dispensing may take place through the valve. Outer shell 4 and intermediate liner 7 are constructed with openings 28 and 18 in their bottom side walls to permit access to heat sealed portal 8. Typically the fitment 38 has a portion 45 (shown in FIG. 4) having a rectangular perimeter to conform to the rectangular perimeter of opening 28. Portion 45 helps hold the fitment 38 in place while the valve 40 is being seated into it.

In accordance with the invention, means is provided for attaching bag 1 to the inner side walls of the outer shell. As embodied, this means comprises flap-like extensions, 5, integrally formed on bag 1. These flap-like extensions may be affixed to the top edges of walls 23 and 24 for securing bag 1 in an erect, uncollapsed configuration.

Also in accordance with the invention is a means for protecting the inner bag from abrasive contact with rough inner surfaces of the outer shell. As embodied, this means comprises a corrugated intermediate lining 7, positioned between the outer shell and bag 1. Intermediate liner 7 is not attached to the bag or the shell. In this way it serves as an abrasion dissipating means which absorbs relative movement between the collapsible bag and the shell so the bag is not subject to abrasive forces. Liner 7 has four side walls, a bottom wall 36 and a top wall 39 constructed to the dimensions of the inner cavity formed by the outer shell 4. To accomplish its purpose of protecting the bag from abrasion, liner 7 is neither attached to bag 1 nor the outer shell 4. Intermediate liner 7 may be constructed with angled or beveled corners and lower extensions of the liner 20 to provide a protective cushioning surface for the heat sealed edges of bag 1. The intermediate liner is constructed with opening 18 to permit access and dispensing from the bottom portal 8 through liner 7.

The container is assembled by first constructing the pallet and shell 4 and then inserting the liner and the bag. The pallet consists of the bottom wall 26 to which the skids 30, 31 and 32 are attached by nailing or similar means. Pallet base members 33, 34 and 35 are affixed by nailing or similar means. Shell 4 is then constructed by nailing, or similarly affixing, the pallet to the bottom edges of outer shell sidewalls 22, 23, 24 and 25. Cleats 37 horizontally traverse the perimeter side walls and index (contact by overlapping) at each corner. As shown in FIG. 2, vertical straps 62 are wrapped about the top wall portions 20,21, cleats 37 and pallet wooden skids 30, 31 and 32. Once the pallet and side walls 22, 23, 24 and 25 are secured, an inner cavity is available for insertion of the intermediate liner 7. Bottom wall 36 and side walls of the intermediate liner are placed inside the cavity. The double collapsible bag 1 is then inserted inside the liner. Flaps 5 of the collapsible bag are stapled or otherwise secured to the top portion of side walls 23 and 24 such that the flaps are sandwiched between the outer walls and the intermediate liner. Top wall of the intermediate liner is placed atop the bag.

The final step of assembly is enclosure of the bag and intermediate liner by setting and securing the top wall 20. The assembly of the component walls is secured by strapping horizontal steel bands 60 traversely to retain the side walls 22, 24, 26, 28 and vertical steel bands 62 longitudinally to secure the top and bottom walls. The cleats 37 prevent bowing of the sidewalls 22, 23, 24, 25 due to the force of the horizontal straps 60. The cleats 37, horizontal straps 60 and vertical straps 62 provide structural strength to the container 4 to hold the weight of a full load of liquid, paste, slurry, etc. in the bag 1.

The amount of liquid load held by the present container is significant. In the case of a 330 gallon water load. The load weight is about 2,750 pounds. It is a significant achievement to be able to load 330 gallons (equal to six 55 gallon drums) into a container having a rectangular cubic shape. Such a container holds the volume of six drums in the space of four drums.

Furthermore, the present container has a significant advantage over other containers, such as those having a corrugated shell. The design of the outer shell of the present container provides structural strength to not only contain a full load of liquid, but also such that fully loaded, the container can be stacked three high for storage. This strength is due to the use of top walls, bottom walls and sidewalls of wood or other nailable/-stapleable material, cleats and strapping. Most preferably the cleats 37 are provided as shown in FIGS. 1, 2, 4, 5, 6 and 8. It is a significant achievement of the container of the present invention that it can be stacked three high. Thus in the space of four drums stacked three high, for a total of twelve drums, the present container stacked three high, holds the volume of eighteen barrels or drums.

Upon delivery, the fluid may be discharged by either top or bottom discharge ports. Top discharge is done by removing the top piece 20, folding back top wall 39 of the corrugated intermediate liner, untying the bag chimney and inserting a drum pump (not shown). The drum pump may be supported by the top member 21. With this method, the bottom discharge means is not touched. For bottom discharge, the portion 8 of the bag sidewall 13 within the heat sealed fitment 38 is cut by a sharp probe on the insertable conventional valve 40 as described above, the valve is seated into the threaded portion of the fitment 38 and gravity discharge proceeds through the seated valve 40.

The above described shipping container may be used to ship bulk fluids under severe shipping conditions and then, after shipment the product may be dispensed from the top or bottom. The emptied container shell may be then be disassembled and discarded or may be reused by insertion of a new collapsible double bag.

Figure 5:
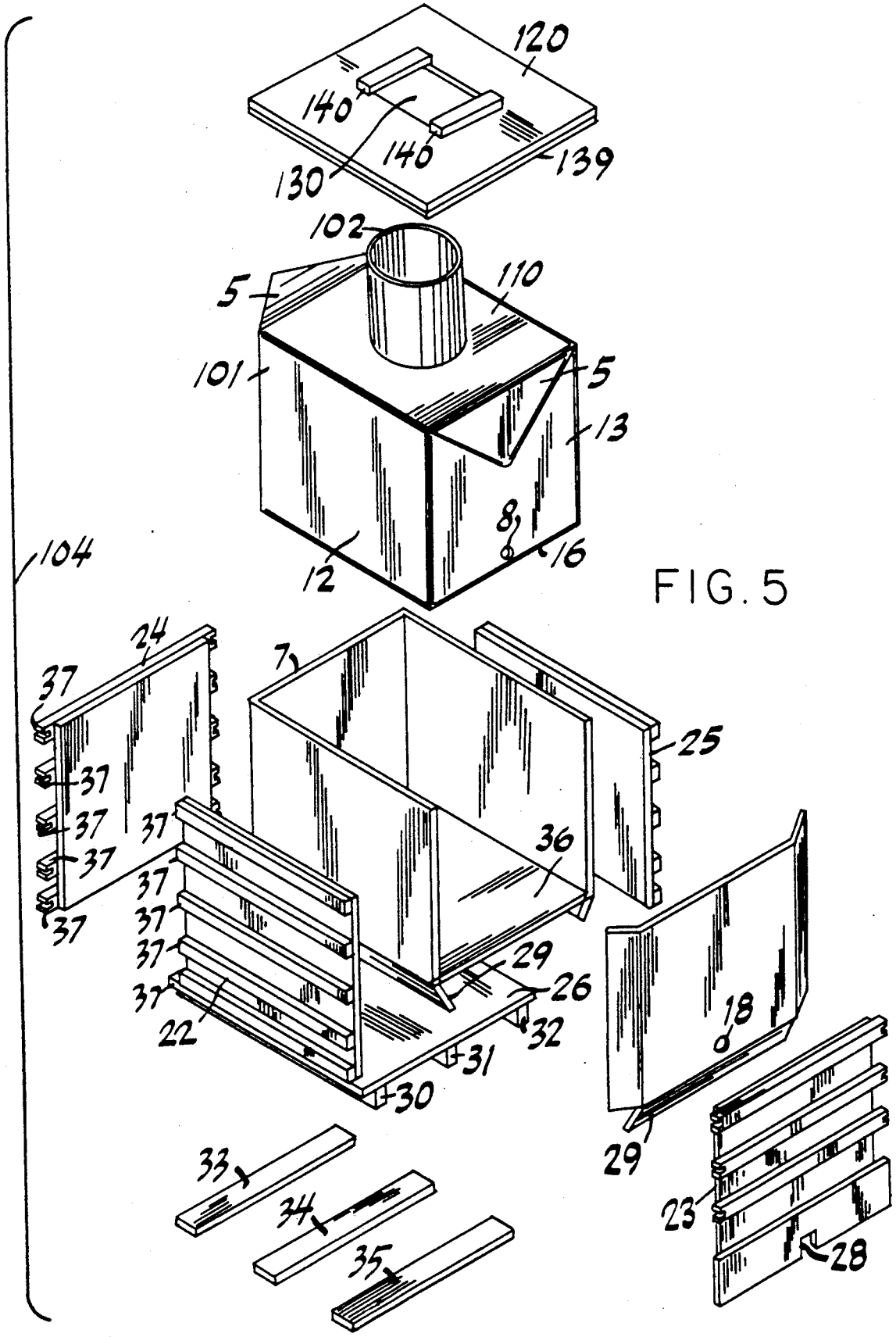
FIG. 5 is an exploded perspective view of a second embodiment of the present invention.

FIG. 5 discloses a second embodiment of the present invention. Elements common to FIG. 1 and any of the other figures are designated with the same numbers. The container of FIG. 5 is the same as that of FIG. 1 except that a top wall 110 of the bag 101 and the top wall 120 of the container shell 104 differ from the top walls of bag 1 and shell 4 of FIG. 1. The top wall 110 of the bag 101 is provided with a chimney like upper portal 102, which is an extension of the collapsible double bag material. When not in use, upper portal 102 is tied with rope or the like and enclosed inside rigid outer shell 104. Upper portal 102 is accessed for either filling or dispensing through a centrally located opening 130 of the top wall 120. Two pieces of wood 140 are nailed or likewise attached to the top wall !20 to flank the opening. The liner has a top wall 139.

Figure 6:
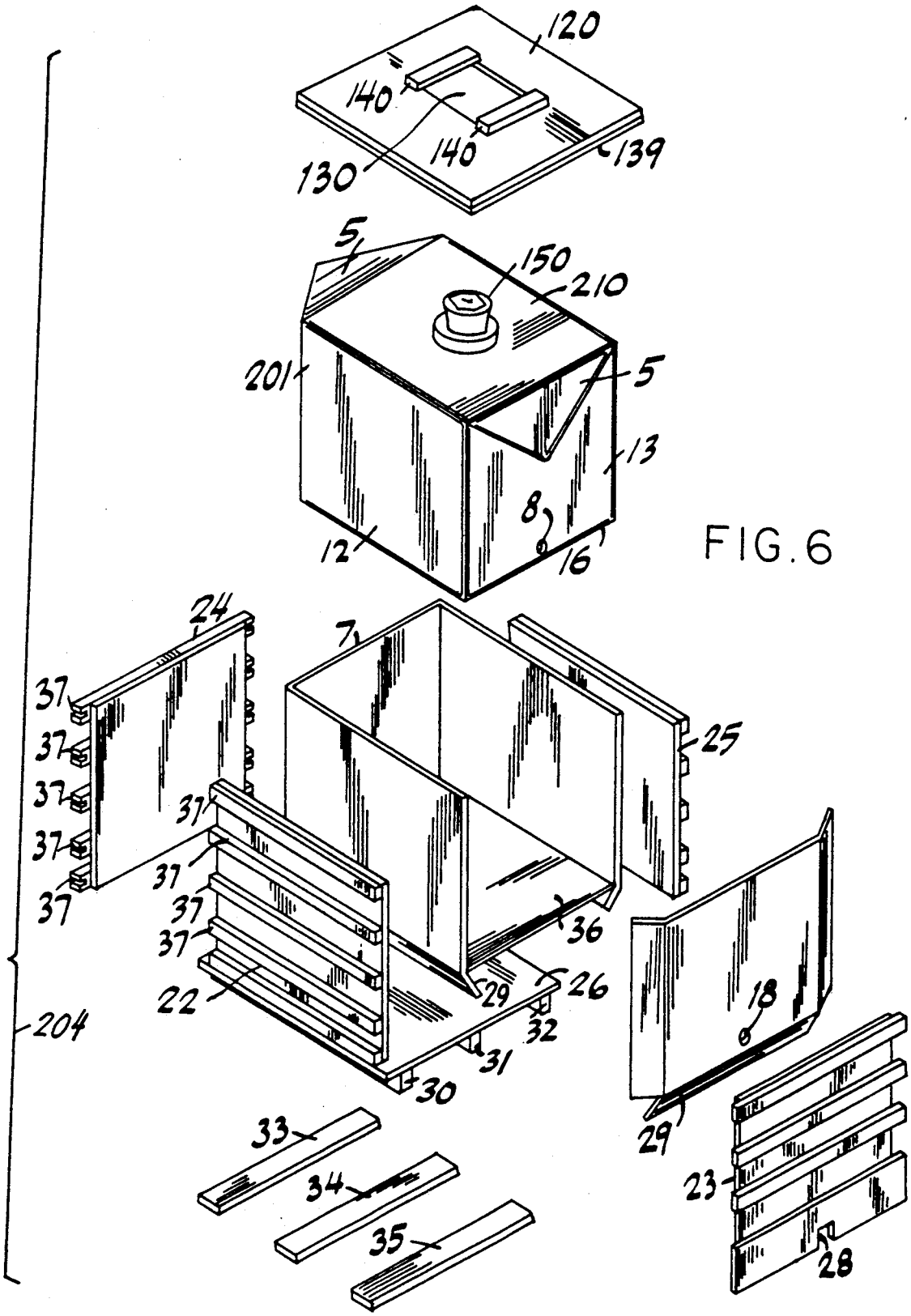
FIG. 6 is a perspective view of a third embodiment of the present invention which employs a bung at a top opening.

FIG. 6 shows a third embodiment of the present invention. Elements common to FIG. 6 and any of the other figures are designated by the same numbers. The container 204 of FIG. 6 is the same as that of FIG. 5 except that the container FIG. 6 has a bung 150 rather than the upper portal 102. The bung 150 is heat sealed to a top wall 210 of a bag 201. The liner has a top wall 239.

Figure 7:
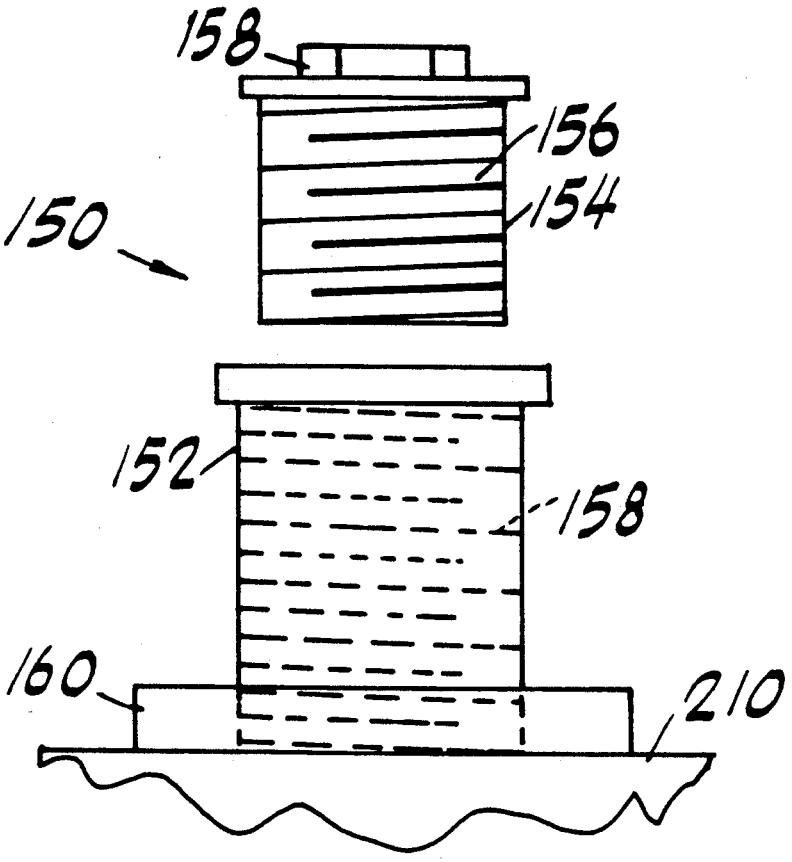
FIG. 7 is a side view of the bung of FIG. 6.

FIG. 7 shows a detailed view of the bung 150. The bung 150 includes a hollow cylinder 150 provided with inner threads 158. The cylinder 152 is integrally attached to an annular base 160. The base 160 is attached to the bag topwall 210. The bung 150 also includes a plug 154 having threads 156. Threads 156 are adapted such that the plug 154 can screw into the cylinder 152. There is a hole (not shown) in the portion of said bag top wall that is aligned with the hollow portion of the cylinder 152. Thus the cylinder 152 is in open communication with the bag 201.

Figure 8:
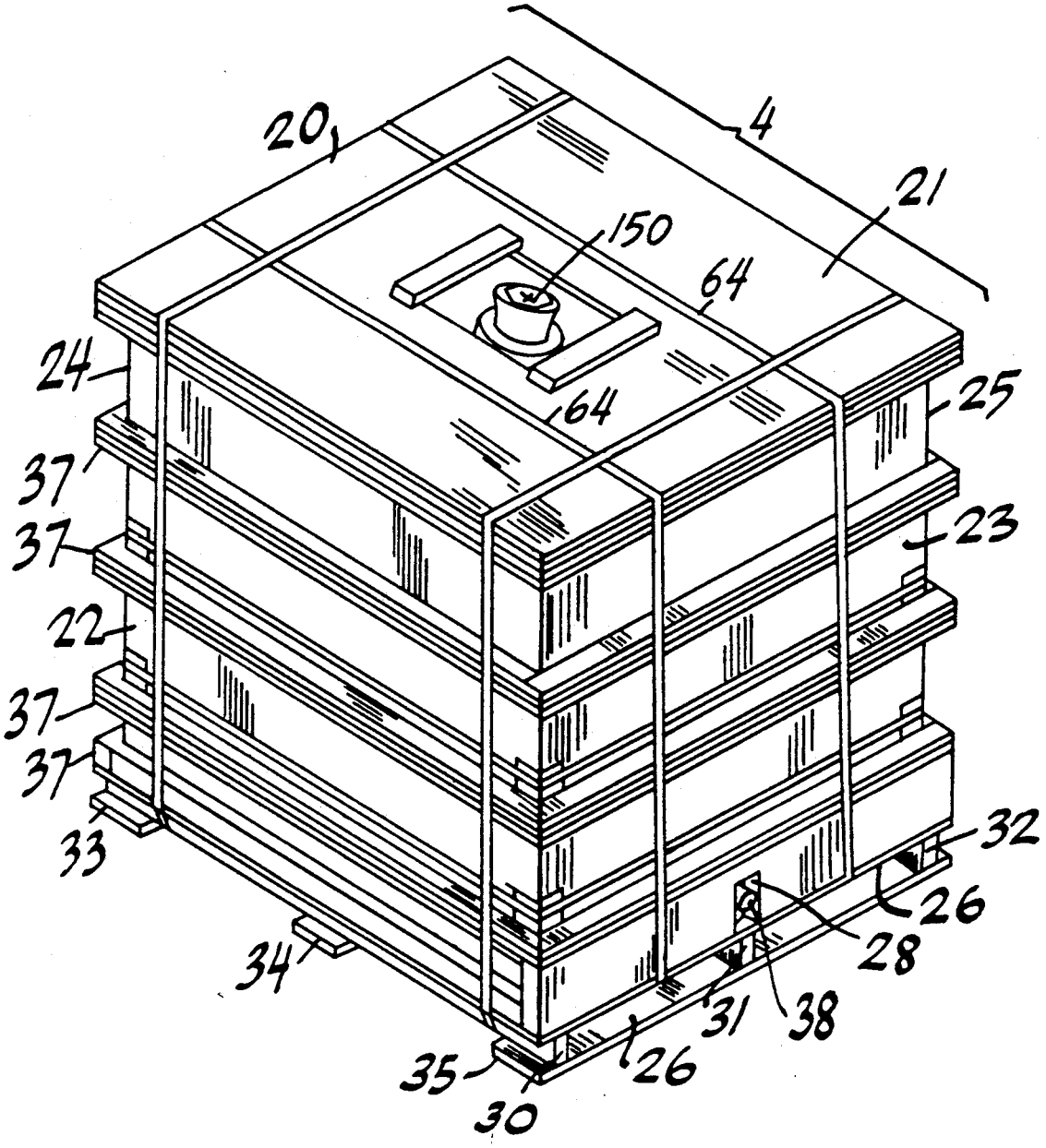
FIG. 8 is a perspective view of the shipping container of FIG. 6.

FIG. 8 shows a second set of vertical straps 64 which are perpendicular to vertical straps 62. Straps 64 wrap around the shell top wall 21, sidewalls 23,24 and bottom wall (deck) 26. The second set of vertical straps can also be employed with the embodiment of FIG. 5.

While specific embodiments of the invention has been shown and described, it should be apparent that many modifications can be made thereto without departing form the spirit and scope of the invention. Accordingly, the invention is not limited by the foregoing description, but is only limited by the claims appended hereto.

I claim:

1. A container and supporting pallet-like structure for the container for bulk handling of fluid which minimizes shock and abrasion on a fluid transporting and dispensing means within the container wherein the container elements are shaped to maximize the quantity of fluid containable therein and the container elements are structured to withstand the pressure exerted by such fluid and permit easy ingress and egress of the fluid from the container comprising:

(a) a rigid outer shell adapted to withstand shock during transportation, said shell comprising a rectangular top wall, and four rectangular sidewalls, the inside of said walls being flat, said shell top wall and shell sidewalls being made of a material capable of attachment by nails or staples, said shell sidewalls being in abutting contact but unattached to each other, said shell top wall being in contact with said shell sidewalls;

(b) a pallet-like structure particularly adopted for permitting movement and storage of said shell without contact with said shell top wall, said pallet-like structure comprising a rectangular deck which is permanently attached to said shell sidewalls and serves as a bottom wall for said shell, said deck having a flat upper surface, said pallet-like structure being made of a material capable of attachment by nails or staples;

(c) a flexible, collapsible bag located inside said shell, said bag having sidewalls, a bottom wall, and a top wall, said bag having a capacity of about 150 gallons to about 400 gallons, said bag comprising integral flaps, which are extensions of the bag material, for securing said bag in an erect uncollapsed configuration within said container, each flap being attached to an inside top portion of said shell sidewalls;

(d) means for permitting fluid passage into or out of said bag through said bag top wall;

(e) a corrugated liner, positioned between said container and said bag, for protecting said bag against abrasion during transportation of said container, wherein said liner is not attached to said shell and said liner is not attached to said bag;

(f) reinforcing cleats attached to said shell sidewalls, said cleats traversing the horizontal perimeter outside said shell, wherein said shell top wall, reinforcing cleats and rectangular deck have a horizontal perimeter of substantially the same dimensions, thereby maximizing the quantity of fluid containable in said container;

(g) horizontal straps, adapted to be positioned about the horizontal perimeter outside said shell, for holding said shell sidewalls in contact with each other;

(h) vertical, straps adapted to be positioned about the vertical perimeter outside said shell, for holding said shell top wall in contact with said shell sidewalls; and (i) a fitment attached to said bag adjacent the bottom of said bag, said fitment having a threaded portion and being adapted for permitting insertion and seating of a valve which is threaded and comprises means for piercing said bag, said corrugated liner and one of said shell sidewalls each having an opening aligned with said fitment, said fitment protruding into said corrugated liner opening and said sidewall opening but not protruding further outside said sidewall than does said cleats;

whereby said container is shippable without said valve.

2. The container of claim 1, wherein said nailable and stapleable material is selected from wood, plywood, particle board, flakeboard or oriented strand board.

3. The container of claim 2, wherein said fitment is heat sealed to said bag from inside said bag.

4. The container of claim 3, wherein said bag comprises two layers.

5. The container of claim 4, wherein said fitment is adapted to be piercable by said valve, wherein said means for piercing of said valve comprises a nail like probe.

6. The container of claim 5, wherein said bag has a rectangular cube shape to match the contours of said shell.

7. The container of claim 6, wherein said bag has a volume from about 250 gallons to about 350 gallons.

8. The container of claim 7, wherein said shell sidewalls are permanently attached to said shell bottom wall by nails.

9. The container of claim 8, wherein said bag is heat sealed to have said rectangular cube shape.

10. The container of claim 9, wherein each cleat on a first opposing pair of said shell sidewalls has about the same length as each sidewall of said first opposing pair and each cleat of a remaining opposing pair of said shell sidewalls have a greater length than each sidewall of said remaining opposing pair;

said first opposing pair of sidewalls and its cleats being between said cleats of said remaining opposing pair of sidewalls; and said remaining opposing pair of sidewalls being between said first opposing pair of sidewalls;

thereby preventing collapse of said shell sidewalls due to the force of said horizontal straps.

11. The container of claim 10, wherein said cleats attached to said remaining pair of opposing sidewalls have grooved corners for aligning said horizontal straps.

12. The container of claim 11, wherein each of said flaps is attached to a top edge of at least two of said shell sidewalls, thereby holding up said bag during loading and unloading.

13. The container of claim 12, wherein said top wall comprises two sections whereby only one of said top wall sections is removed to permit passage of fluid through said top wall.

14. The container of claim 12, wherein said shell top wall has a hole therethrough which is aligned with said means for permitting passage of fluid through said bag top wall.

15. The container of claim 14, wherein said means permitting passage through said bag top wall is a chimney-like collapsible passageway extending from said top wall, said passageway having an open and a closed position, said open position providing ingress and egress from said container, and said closed position being sufficiently flush with said shell top wall to enable stacking of another container upon said shell top wall.

16. The container of claim 14, wherein said means permitting passage through said bag top wall is a bung which is heat sealed to said bag top wall.

* * * * *